US007021516B2

(12) United States Patent
Smolinski et al.

(10) Patent No.: US 7,021,516 B2
(45) Date of Patent: Apr. 4, 2006

(54) DRIVER BLADE FOR FASTENING TOOL

(75) Inventors: Darek Smolinski, Chicago, IL (US); Allan F. Miller, Lindenhurst, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/794,223

(22) Filed: Mar. 5, 2004

(65) Prior Publication Data

US 2005/0194419 A1 Sep. 8, 2005

(51) Int. Cl.
*B25C 1/04* (2006.01)

(52) U.S. Cl. ..... 227/156; 227/130; 227/147

(58) Field of Classification Search ..... 227/156, 227/119, 130, 136, 140, 141, 147
See application file for complete search history.

(56) References Cited

U.S. PATENT DOCUMENTS

| | | | | |
|---|---|---|---|---|
| 3,522,771 | A * | 8/1970 | Jacoby | 104/88.06 |
| 4,305,541 | A * | 12/1981 | Barrett et al. | 227/120 |
| 4,573,623 | A * | 3/1986 | Sexton et al. | 227/66 |
| 5,647,525 | A | 7/1997 | Ishizawa | |
| 5,927,585 | A * | 7/1999 | Moorman et al. | 227/132 |
| 6,045,024 | A * | 4/2000 | Phillips | 227/130 |
| 6,364,193 | B1 * | 4/2002 | Tsai | 227/131 |
| 6,564,604 | B1 * | 5/2003 | Kefferstein et al. | 72/47 |
| 6,622,901 | B1 * | 9/2003 | Hamano et al. | 227/119 |
| 6,705,503 | B1 * | 3/2004 | Pedicini et al. | 227/131 |

FOREIGN PATENT DOCUMENTS

| | | | |
|---|---|---|---|
| JP | 08116416 | | 5/1996 |
| JP | 409300238 | A * | 11/1997 |

OTHER PUBLICATIONS

Thomson Delphion Search, JP9300238A2 driving blade of driving machine, 1 page.
Patent Abstracts of Japan, 09300238, 16 pages.
Thomson Delphion Search, JP8112780A2 driving blade of driving machine, 1 page.
Patent Abstracts of Japan, 08112780, 1 page.

* cited by examiner

*Primary Examiner*—Stephen F. Gerrity
*Assistant Examiner*—Thanh Truong
(74) *Attorney, Agent, or Firm*—Lisa M. Soltis; Mark W. Croll; Beem Patent Law Firm

(57) ABSTRACT

A novel driver blade for use in a fastening tool having a piston is provided comprising an elongate body, a head at one end of the body for coupling to the piston, a tip at the other end of the body for impacting a fastener to drive said fastener into a workpiece, and a stiffening rib protruding from the body, the rib extending substantially along the length of the body, wherein the stamped elongate driver blade is made of annealed cold rolled spring steel. A novel method of manufacturing an elongate driver blade is also provided comprising the steps of providing cold rolled spring steel, forming an elongate blank from the cold rolled spring steel, providing a stamping die having a generally planar stamping surface with an elongate groove in the stamping surface, and stamping the blank into the stamping die with the elongate groove to form the elongate driver blade having an elongate stiffening rib.

5 Claims, 2 Drawing Sheets

DRIVER BLADE FOR FASTENING TOOL

BACKGROUND OF THE INVENTION

1. Field of the Invention

The present invention is directed to a driver blade for use in a fastening tool, particularly for a fastening tool for driving fasteners for fastening trim for finishing applications.

2. Description of the Related Art

Driver blades for fastening tools are used to drive fasteners, such as those used to secure trim or molding for finishing applications. For finishing applications, driver blades are typically long, thin, unsupported pieces of metal which must repeatedly strike fasteners with a significant amount of force. The driver blade must be strong and durable enough to withstand thousands of cycles.

In order to ensure that a driver blade has the strength and durability required to withstand a large number of cycles, driver blades have typically been made by machining a bar of steel or other metal having the desired strength and hardness, see for example the driver blade disclosed in U.S. Pat. No. 5,647,525. However, machining a driver blade can be overly expensive, a problem that is exacerbated by the fact that driver blades typically have to be changed out due to wear several times during the life of a tool.

What is needed is a driver blade with the strength and durability to withstand a large number of driving cycles, but that is inexpensive to manufacture.

BRIEF SUMMARY OF THE INVENTION

The novel stamped elongate driver blade includes an elongate body, a head at one end of the body for coupling to the piston, a tip at the other end of the body for impacting a fastener to drive it into a workpiece, a stiffening rib protruding from the body, the rib extending substantially along the length of the body, wherein the stamped elongate driver blade is made of annealed cold rolled spring steel.

Also in accordance with the present invention, an inventive method of manufacturing an elongate driver blade is provided having the steps of providing cold rolled spring steel, forming an elongate blank from the cold rolled spring steel, providing a stamping die having a generally planar stamping surface with an elongate groove, and stamping the blank into the stamping die having the elongate groove to form the elongate driver blade having an elongate stiffening rib. A novel driver blade is manufactured by the method described above.

DETAILED DESCRIPTION OF THE INVENTION

Figure 1:
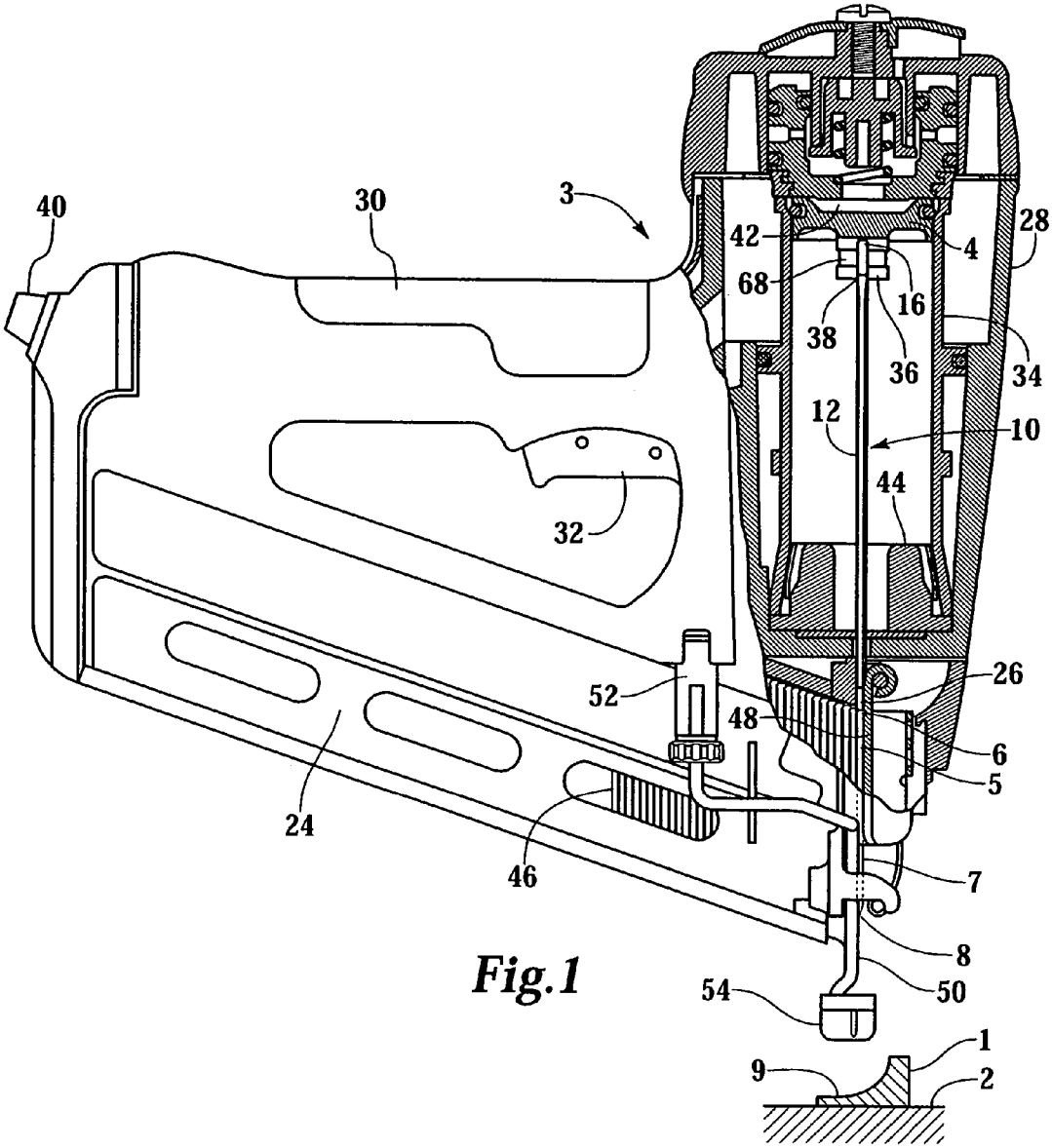
FIG. 1 is partial side sectional view of a tool having a driver blade of the present invention.
Figure 3:
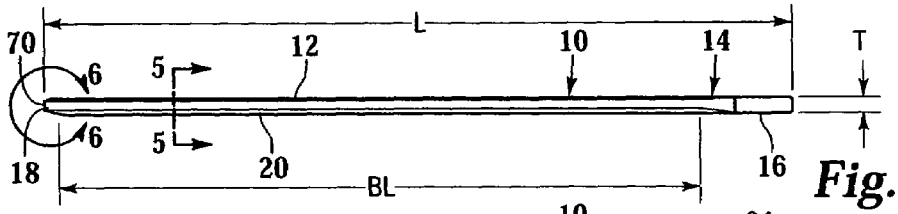
FIG. 3 is a side view of the driver blade of the present invention.
Figure 4:
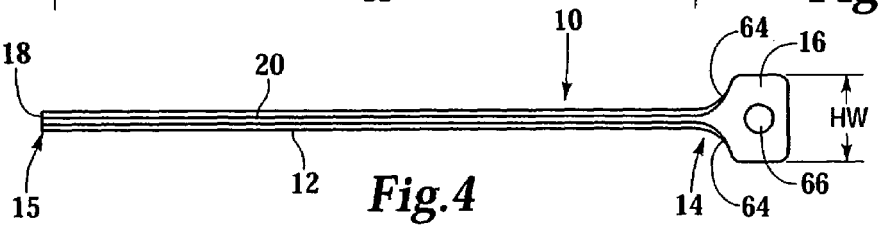
FIG. 4 is an elevation view showing an elongate rib extending along the driver blade.

Referring to FIGS. 1, 3 and 4, a novel stamped elongate driver blade 10 includes an elongate body 12, a head 16 at a trailing end 14 of body 12 for coupling to piston 4, a tip 18 at a driving end 15 of body 12 for impacting and driving a fastener 5 into a workpiece 1, and an elongate stiffening rib 20 protruding from elongate body 12 and extending substantially along the length of elongate body 12, wherein stamped elongate driver blade 10 is made of annealed cold rolled spring steel having a Rockwell C hardness of between about 54 and about 57.

Figure 2:
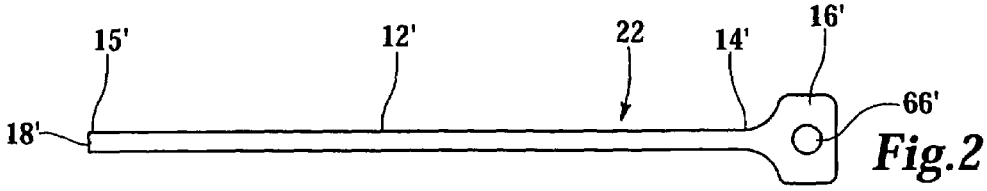
FIG. 2 is an elevation view of an elongate blank used to form the driver blade of the present invention.
Figure 7:
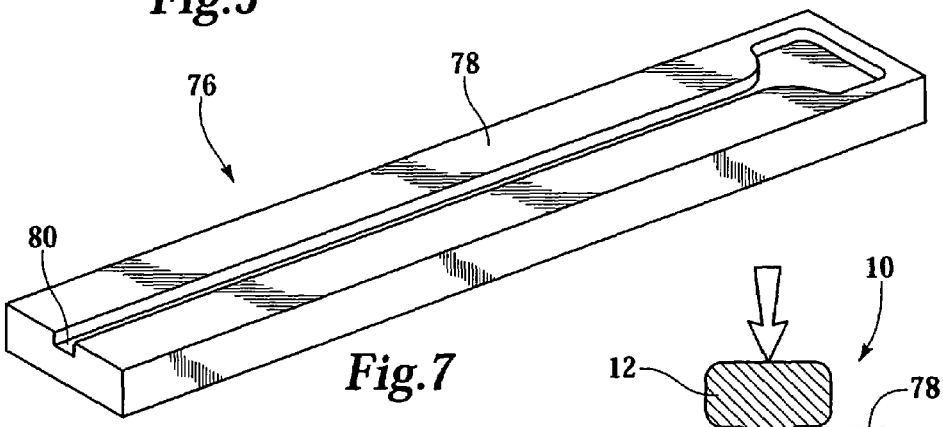
FIG. 7 is a perspective view of a stamping die for forming the driver blade.
Figure 8:
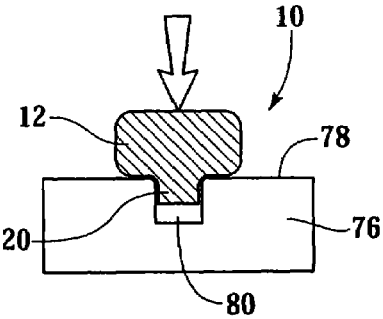
FIG. 8 is a sectional view of the stamping die and the driver blade.

Driver blade 10 is made from a novel method of manufacturing including the steps of providing cold rolled spring steel, forming an elongate blank 22, see FIG. 2, from the cold rolled spring steel, providing a stamping die 76, see FIGS. 7 and 8, having a generally planar stamping surface 78 with an elongate groove 80, and stamping blank 22 into stamping die 76 having elongate groove 80 to form elongate driver blade 10 having an elongate stiffening rib 20.

Fastening Tool

Turning to FIG. 1, tool 3 is used for driving fasteners 5 into a workpiece 1. In a preferred embodiment, tool 3 is used for driving pins 5 for fastening a workpiece 1, such as molding or trim having a ledge 9 as shown in FIG. 1, to a substrate 2, such as a wall or a cabinet. Fasteners 5 may be rectangular or round. In a preferred embodiment particularly suited for trim applications, each fastener 5 has a generally rectangular cross section corresponding generally to the cross section of body 12 of driver blade 10. Each fastener 5 can have a generally rectangular head 6, a generally rectangular shaft 7 and a point 8. A plurality of fasteners 5 can be coupled together in a strip 46 and placed in a magazine 24 of tool 3, as shown in FIG. 1. The fastener 5 that is to be driven by driver blade 10 is positioned within a channel 26 at the driving end of tool housing 28. Channel 26 acts to guide driver blade 10 and fastener 5 in the driving direction toward workpiece 1.

Tool 3 includes a housing 28 with a handle 30 depending generally from a trailing end of housing 28 for an operator to hold tool 3. A trigger 32 is mounted to handle 30 for actuating tool 3. A cylinder 34 is located within housing 28, with a piston 4 within cylinder 34. Driver blade 10 is coupled to piston 4 so that when piston 4 is driven in a driving direction through cylinder 34, so is driver blade 10. In one embodiment, piston 4 includes a stem 36 having a recess 38 for receiving head 16 of driver blade 10, as described below.

A power source, such as pneumatic power, gas combustion, or explosive powder is used to drive piston 4 and driver blade 10 in the driving direction toward fastener 5. In one embodiment, tool 3 includes an air connection 40 for connecting to a compressed air source (not shown), which feeds into a chamber 42 in the trailing direction of piston 4. When trigger 32 is pulled by an operator, air pressure is increased in chamber 42, which drives piston 4 toward fastener 5. Tool 3 can also include a buffer 44 generally at the driving end of cylinder 34 to protect piston 4 and tool 3 from damage due to high speed impact.

Preferably, tool 3 includes a magazine 24 for feeding a strip 46 of fasteners 5 into channel 26. Tool 3 can also include a follower (not shown) which biases strip 46 toward channel 26, so that when one fastener 5 is driven, the follower biases the next fastener 5 into channel 26. Tool 3 also includes a front plate 48, which frames part of channel 26, and preferably can be temporarily removed, such as by the hinged connection to housing 28 shown in FIG. 1, so that channel 26 can be opened to perform maintenance, such as removing debris from channel 26. Front plate 48 can include a groove (not shown) for guiding rib 20 of driver blade 10. The groove in front plate 48 cannot be wider than fastener head 6 because if it was, fastener 5 would slide into the groove and would not be driven properly by driver blade 10.

Continuing with FIG. 1, tool 3 also includes a drive probe 50 extending in the driving direction from housing 28. Drive probe 50 is operationally connected to a triggering mechanism (not shown) via a link 52, so that tool 3 cannot be fired without driver probe 50 being pushed against workpiece 1, forcing drive probe 50 and link 52 in the trailing direction, enabling actuation of tool 3. In one embodiment, a work contact element 54 is mounted to drive probe 50 to prevent drive probe 50 from marring the surface of workpiece 1. An example of a work contact element is disclosed in the commonly assigned, co-pending patent application having Ser. No. 10/655,431 filed contemporaneously herewith, the disclosure of which is incorporated herein by reference.

Driver Blade

Figure 5:
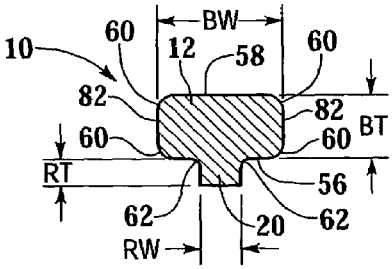
FIG. 5 is a cross-sectional view of the driver blade taken along line 5—5 in FIG. 3.

Turning to FIGS. 3–5, driver blade 10 is formed by stamping cold rolled spring steel. Driver blade 10 includes an elongate body 12, a head 16 at trailing end 14 of body 12 for coupling to piston 4, a tip 18 at driving end 15 of body 12 for impacting and driving fastener 5 in a driving direction into workpiece 1, a stiffening rib 20 protruding from body 12 and extending substantially along the length BL of body 12, wherein stamped elongate driver blade 10 is preferably made of annealed cold rolled spring steel having a Rockwell C hardness of between about 54 and about 57.

Elongate body 12 of driver blade 10 extends between head 16 and tip 18. Preferably, body 12 is generally rectangular in cross section, as shown in FIG. 5, to complement the generally rectangular fastener head 6. The width BW and thickness BT of body 12 is preferably approximately equal to the width and thickness, respectively, of fastener head 6. The length BL of body 12 is a significant portion of the total length L of driver blade 10. Body 12 includes a first face 56 and a second face 58, wherein stiffening rib 20 protrudes from first face 56 of body 12 and extends substantially along the entire length BL of body 12 to provide durability and column strength along the length of driver blade 10. Preferably, rib 20 is generally centered along the width BW of body 12, as shown in FIG. 5, wherein the width RW of rib 20 is significantly less than the width BW of body 12. Rib 20 protrudes from first face 56 of body 12 for a thickness RT of rib 20 that is less than the thickness BT of body 12. Thickness RT of rib should be large enough to provide sufficient strength and durability along the length of driver blade 10 to allow driver blade 10 to last a desired number of cycles, preferably several hundred thousand cycles. Because the width of the grove in face plate 48, FIG. 1, cannot be larger than the width of fastener head 6, rib 20, which slides along the groove in face plate 48, also cannot have a width RW larger than the width of fastener head 6. Body 12 and rib 20 are manufactured by a stamping process, described below.

In one embodiment, body 12 has a length BL that is between about 70% and about 95%, preferably between about 80% and about 92%, still more preferably about 90% of the total length L of driver blade 10. The thickness BT of body 12 can be between about 50% and about 90%, preferably between about 65% and about 75%, still more preferably about 70% of the total thickness T of driver blade 10. Width RW of rib 20 can be between about 25% and about 50%, preferably between about 30% and about 40%, still more preferably about 32% of the width BW of body 12. In one embodiment, the length BL of body 12 is between about 4 inches and about 4.75 inches, preferably about 4.4 inches, the width BW of body 12 is between about 0.1 inch and about 0.15 inch, preferably about ⅛ inch, the thickness BT of body 12 is between about 0.06 inch and about 0.07 inch, preferably about 0.065 inch, the thickness RT of rib 20 is between about 0.02 inch and about 0.05 inch, preferably about 0.03 inch, and the width RW of rib 20 is between about 0.03 inch and about 0.05 inch, preferably about 0.04 inch.

Continuing with FIG. 5, preferably body includes rounded edges 60 and a rounded juncture 62 between body 12 and rib 20, which can also be formed by stamping, because sharp edges more easily form concentrations of stress and fault lines at the high forces experienced by driver blade. Similarly, preferably there are flared portions 64 between body 12 and head 16, as shown in FIG. 4, to prevent the formation of fault lines between body 12 and head 16. In one embodiment, rounded edges 60 have a radius of curvature of about 0.015 inch, rounded juncture has a radius of curvature of about 0.01 inch, and flared portions 64 between body 12 and head 16 have a radius of curvature of about 0.25 inches.

Head 16 is located at a trailing end 14 of body 12 and is substantially wider than body 12, as seen in FIG. 4. Head 16 fits within recess 38 for coupling with piston 4. In one embodiment, head 16 includes a hole 66 for receiving a pin 68 extending through piston stem 36 and hole 66, see FIG. 1. Pin 68 is removable to allow for routine maintenance and replacement of driver blade 10. In one embodiment, head 16 has a width HW that is between about three and about six times wider than the width BW of body 12, preferably about 4¾ times wider. In one embodiment, head 16 has a width HW of between about 0.4 inches and about ¾ inch, preferably between about ½ inch and about 0.6 inches, still more preferably about 0.59 inches.

Figure 6:
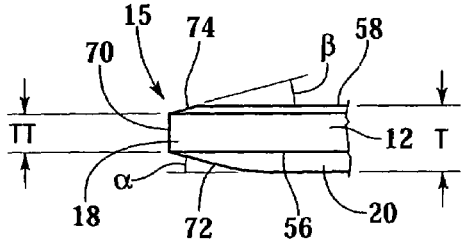
FIG. 6 is a close up of a tip of the driver blade taken along detail 6 in FIG. 3.

Turning to FIGS. 3 and 6, tip 18 is located at driving end 15 of body and includes a driving surface 70 for impacting head 6 of fastener 5 within channel 26, see FIG. 1. Driving surface 70 is substantially normal to body 12 so that driving surface 70 will strike fastener head 6 true and evenly. In one embodiment, driving surface 70 is the only portion of driver blade 10 that is machined to ensure that driving surface is substantially flat and normal with body 12 of driver blade 10.

Continuing with FIG. 6, tip 18 can also include a first tapered portion 72 of first face 56 and a second tapered portion 74 of second face 58 that tapers toward driving surface 70 at driving end 15, wherein the thicknesses of both body 12 and rib 20 taper to a thickness TT of driving surface 70 that is between about 35% and about 80%, preferably between about 50% and about 70%, still more preferably about 60% of the total thickness T of driver blade 10. In one embodiment, first tapered portion 72 is tapered toward driving surface 70 at an angle a of between about 10° and about 20°, preferably about 15°, second tapered portion 74 is tapered toward driving surface 70 at an angle β of between about 10° and about 20°, still more preferably about 15°, and driving surface 70 has a thickness TT of between about 0.03 inch to about 0.75 inch, preferably about ½ inch to about 0.06 inch, still more preferably about 0.055 inch.

Tapered portions 72, 74 make driver blade 10 as thin as possible at driving end 15 so that there is little chance that driver blade 10 will damage workpiece 1, because the portion of driver blade 10 that workpiece 1 sees is smaller than fastener head 6. Also, second tapered portion 74 ensures that driving surface 70 contacts only fastener 5 within channel 26, and not the next fastener over, because second tapered portion 74 slides down the next fastener so that driving surface 70 contacts head 6 of the fastener in channel 26.

Method of Manufacture

Driver blade 10 is made by a novel method of manufacture wherein the driver blade is stamped instead of machined. The novel method includes the steps of providing cold rolled spring steel, forming an elongate blank 22 from said cold rolled spring steel, as shown in FIG. 2, providing a stamping die 76 having a generally planar stamping surface 78 with an elongate groove 80 in stamping surface 78, and stamping blank 22 into stamping die 76 with elongate groove 80 to form elongate driver blade 10 having an elongate stiffening rib 20.

The cold rolled spring steel that is provided is preferably 1095 cold rolled steel, although S7 or 1050 spring can also be used. Preferably, the cold rolled spring steel is an annealed spring steel available in stock rolls of steel. A preferred stock spring steel is 1095 steel that can be purchased in stock rolls having a thickness of about 0.093 inches.

The step of forming blank 22 out of the steel preferably forms a blank 22 having the same general shape as a completed driver blade 10, see FIGS. 1 and 3. Blank 22 has a body 12', a head 16' at a trailing end 14' of body 12', and a tip 18' at a driving end 15' of blank 22. Blank 22 can be formed by any method that forms the desired shape, such as by cutting the shape, but stamping is preferred because it is easily repeatable and inexpensive. Stamping can also form hole 66' in head 16' of blank 22, either at generally the same time as stamping blank 22, or at some other time.

Stamping blank 22 into stamping die 76 comprises stamping blank 22 with sufficient force to deform the spring steel to form stiffening rib 20. The stamping step forms rib 20 within elongate groove 80 of stamping die 76 by forcing steel into elongate groove 80 and by stamping down the metal adjacent to rib 20, as shown in FIG. 8.

In one embodiment, the method also includes the step of trimming body 12 of driver blade 10 to a predetermined width. Because blank 22 is deformed by stamping die 76 to form stiffening rib 20, some of the metal is forced outwardly so that body 12 of driver blade 10 is wider than desired, making it necessary to trim sides 82 of body 12 to a desired width BW. The method can also include the steps of stamping edges 60 of body 12 so that they are generally rounded, as shown in FIG. 5, to prevent the concentration of stress and the formation of fault lines. Tapered portions 72, 74 of tip 18 can also be formed by stamping.

A step of heat treating driver blade 10 can also be included in the method after driver blade 10 has been stamped so that the spring steel will have the hardness, strength and durability desired. In one embodiment, driver blade 10 is heat treated so that it is hard enough to withstand a predetermined number of cycles, preferably 250,000 cycles or more. Preferably, driver blade 10 is heat treated to a Rockwell C hardness of between about 52 and about 60, preferably between about 54 and 57.

Stamping of driver blade 10 is significantly cheaper than machining a driver blade out of a similar metal. Stamping of driver blade 10 out of cold rolled spring steel costs less than 10% of the cost of machining a similar driver blade. Surprisingly, driver blade 10 formed by the stamping method is also substantially more durable than a typical machined driver blade made from similar materials. Under certain conditions, a conventional machined driver blade was able to withstand approximately 250,000 cycles before needing to be replaced. Under the same conditions, driver blade 10 of the present invention, manufactured from the stamping process, was able to withstand approximately 600,000 cycles before needing to be replaced.

While the foregoing written description of the invention enables one of ordinary skill to make and use what is considered presently to be the best mode thereof, those of ordinary skill will understand and appreciate the existence of variations, combinations, and equivalents of the specific exemplary embodiment and method herein. The invention should therefore not be limited by the above described embodiment or method, but by all embodiments and methods within the scope and spirit of the invention.

What is claimed is:

1. A stamped elongate driver blade for use in a fastener driving tool having a piston, said driver blade comprising:

an elongate body having a thickness and first and second opposite faces;

a head at one end of said body for coupling to said piston;

a tip at the other end of said body having a driving surface having a thickness for impacting a fastener to drive said fastener into a work piece, wherein said tip has a first tapered portion on said first face and a second tapered portion on said second face that taper toward said driving surface; and a stiffening rib protruding from said first face of said body having a thickness, said rib extending substantially along the length of said body;

wherein said body thickness and said rib thickness taper at said tip to said driving surface thickness.

2. A driver blade according to claim 1, wherein said driver blade and said rib have a generally T-shaped cross section.

3. An elongate driver blade according to claim 1, wherein said elongate driver blade is heat treated to a predetermined hardness.

4. An elongate driver blade according to claim 1, wherein said driving surface thickness is between about 35% and about 80% of said body thickness.

5. An elongate driver blade according to claim 1, wherein said first tapered portion and said second tapered portion taper toward said driving surface at between an about 10 degree and an about 20 degree angle.

* * * * *